US012800208B2

(12) United States Patent
Schmitt

(10) Patent No.: US 12,800,208 B2
(45) Date of Patent: Nov. 17, 2026

(54) METHOD FOR CONTROLLING THE FILL LEVEL OF AN OIL SEPARATOR FOR A COOLING CIRCUIT AND ASSOCIATED SYSTEM

(71) Applicant: TEKO Gesellschaft für Kältetechnik mbH, Altenstadt (DE)

(72) Inventor: Andreas Schmitt, Maintal (DE)

(73) Assignee: TEKO Gesellschaft für Kältetechnik mbH, Altenstadt (DE)

( * ) Notice: Subject to any disclaimer, the term of this patent is extended or adjusted under 35 U.S.C. 154(b) by 0 days.

(21) Appl. No.: 19/118,950

(22) PCT Filed: Oct. 9, 2023

(86) PCT No.: PCT/EP2023/077933
§ 371 (c)(1),
(2) Date: Apr. 7, 2025

(87) PCT Pub. No.: WO2024/074729
PCT Pub. Date: Apr. 11, 2024

(65) Prior Publication Data
US 2026/0009571 A1 Jan. 8, 2026

(51) Int. Cl.
*F25B 49/02* (2006.01)
*F25B 43/02* (2006.01)

(52) U.S. Cl.
CPC ..... *F25B 49/02* (2013.01); *F25B 43/02* (2013.01)

(58) Field of Classification Search
CPC ..... F25B 49/02; F25B 31/004; F25B 49/022; F25B 43/006; F25B 2700/2105; F25B 2400/23; F25B 43/02
See application file for complete search history.

(56) References Cited

U.S. PATENT DOCUMENTS 5,894,740 A * 4/1999 Renz ..... F16N 39/02 62/84
2010/0126211 A1 5/2010 Okamoto et al.
2021/0207859 A1* 7/2021 Kato ..... F25B 13/00

FOREIGN PATENT DOCUMENTS

DE 4140625 A1 * 6/1993 ..... F25B 31/004
JP 2001289519 A 10/2001
JP 5418253 B2 11/2013
(Continued)

OTHER PUBLICATIONS

International Preliminary Report on Patentability for PCT Application No. PCT/EP2023/077933 dated Dec. 18, 2024, 14 pages.
(Continued)

*Primary Examiner* — Frantz F Jules
*Assistant Examiner* — Martha Tadesse
(74) *Attorney, Agent, or Firm* — Michael T. Abramson; Jordan IP Law, LLC

(57) ABSTRACT

A method for controlling the fill level of an oil separator (2) for a cooling circuit (K), comprising a controllable valve (5) connected downstream of outlet of an the oil separator (2), is intended to enable the lowest possible loss of pressure and energy, and yet is low-maintenance and technically simple to implement. For this purpose, after the valve (5) is opened, a first temperature is measured in a region downstream of the valve (5), a limit value for at least one parameter that is characteristic of a change in the first temperature is specified, and a closing of the valve (5) results as soon as the parameter exceeds the specified limit value.

10 Claims, 4 Drawing Sheets

(56) References Cited

FOREIGN PATENT DOCUMENTS

Figure 1:
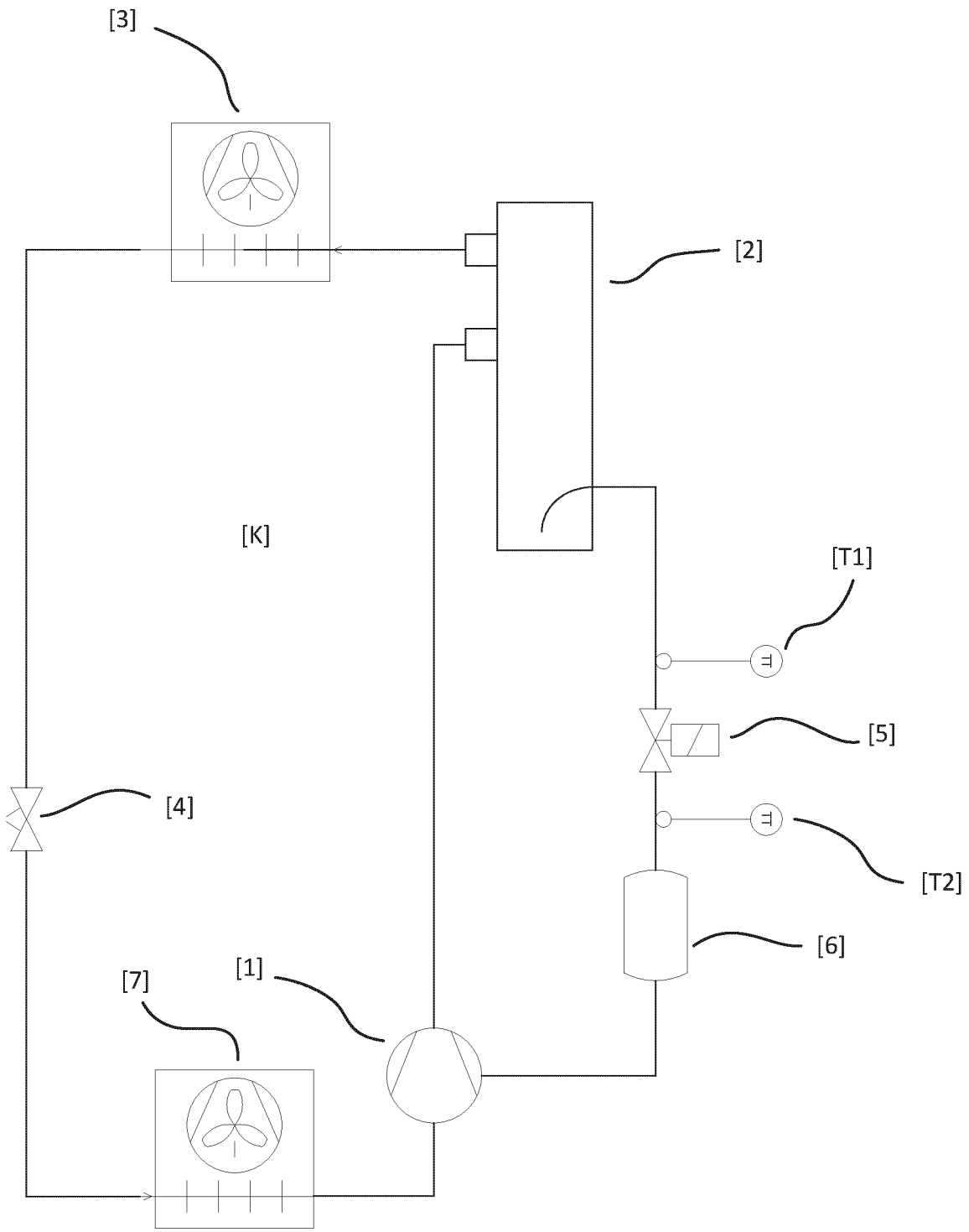

| | | | |
|---|---|---|---|
| KR | 20080008095 | A | 1/2008 |
| WO | 2008117511 | A1 | 10/2008 |

OTHER PUBLICATIONS

English Translation of the International Preliminary Report on Patentability for PCT Application No. PCT/EP2023/077933 dated Apr. 10, 2025, 8 pages.
Notice of Acceptance for Australian Patent Application No. 2023357509 mailed Jun. 11, 2025, 4 pages.

* cited by examiner

METHOD FOR CONTROLLING THE FILL LEVEL OF AN OIL SEPARATOR FOR A COOLING CIRCUIT AND ASSOCIATED SYSTEM

CROSS-REFERENCE TO RELATED APPLICATIONS

This application is a U.S. National Stage of International Patent Application No. PCT/EP2023/077933, filed on 9 Oct. 2023, which claims priority to German Application No. 102022125945.5, filed on 7 Oct. 2022. The disclosures of which are incorporated herein by reference in their entirety.

The invention relates to method for regulating the fill level of an oil separator for a cooling circuit, comprising a controllable valve connected downstream of an outlet of the oil separator, which oil through is fed into an oil collecting container. It also relates to a system comprising an oil separator and an oil collecting container connected downstream on the outlet side via a valve, as well as a cooling circuit with such a system.

A cooling circuit is a system that is used to cool a device to a desired temperature, for example a freezer for food. A refrigerant that is moved in the closed circuit undergoes various changes of aggregate state one after the other: The gaseous refrigerant is first compressed by a compressor. It then condenses in the subsequent heat exchanger, releasing heat. The liquid refrigerant is then expanded due to the change in pressure via a throttle element, for example an expansion valve or a capillary tube. In the downstream second heat exchanger (evaporator), the refrigerant evaporates by absorbing heat at a low temperature (boiling cooling). The cycle can now start again. The process must be kept in motion by supplying mechanical work (drive power) from the outside via the compressor.

Oil is used as a lubricant in the compressor. Due to the design, some of the oil always ends up in the discharged compressed refrigerant. An oil separator is therefore usually installed downstream of the compressor on the outlet side, which can be designed as an impact separator, for example, and in which the oil is removed from the refrigerant. The separated oil is not discarded, but is fed into an oil collecting container via a separate oil circuit and fed back to the compressor from there.

This separate oil circuit connects the outlet of the oil separator with the oil collecting container, i.e. a part of the cooling circuit downstream of the compressor and therefore under high pressure, with the low-pressure inlet area of the compressor. It can therefore not remain permanently open, as this would result in a permanent loss of pressure and therefore energy, and is therefore fitted with a controllable valve.

Known methods include either opening the valve as required to detect the fill level of the oil separator, e.g. via optical detection or floats, or simple time controls that open the valve for a specified time in a regular cycle. However, measuring the fill level of the oil separator is prone to soiling and can be technically complex. In addition, they are often not suitable for all temperatures in the oil collecting container. Time controls, on the other hand, are often not tailored to requirements and result in the valve opening for too long.

It is therefore the object of the invention to specify a process of the type mentioned at the beginning, which enables the lowest possible loss of pressure and energy, and yet is low-maintenance and technically simple to implement.

According to the invention, this object is solved by measuring a first temperature in a line between the valve and the oil collecting container after the valve is opened, specifying a limit value for at least one parameter that is characteristic of a change in the first temperature, and closing the valve as soon as the parameter exceeds the specified limit value.

The invention is based on the idea that the oil separator can be emptied into the oil collecting container as required not only by opening the oil separator as required when an excessive level is detected, but also by precisely controlling the opening time of the valve. For this purpose, the valve should be closed again after opening at the precise time when all the oil has been removed from the oil separator. In order to determine this time precisely, it should be determined exactly whether oil is still flowing through the valve or whether refrigerant is already flowing through the valve, i.e. the oil supply in the oil separator is exhausted. As the refrigerant in the oil separator was usually compressed immediately beforehand, it is under high pressure and in gaseous form. An isenthalpic change of state occurs in the valve between the oil separator and the oil collecting container. The refrigerant is gaseous, while the oil is in the liquid phase, so that both media behave differently under the isenthalpic change of state: The expansion of the gaseous refrigerant leads to a temperature drop across the valve, whereas no such temperature change is to be expected with liquid oil. The flow of oil or refrigerant can therefore be detected in the valve by this temperature characteristic. By specifying suitable parameters characteristic of the temperature and suitable limit values, precise closing of the valve after opening can be achieved, which takes place exactly when the entire oil supply has been transferred from the oil separator to the oil collecting container.

In an advantageous embodiment, a rate of change of the first temperature is used as a parameter. In other words, the mathematical derivation of the temperature curve measured downstream of the valve is determined and itself or a correspondingly derived variable is used as a parameter for which a limit value is specified. As soon as a particularly rapid drop in temperature (i.e. above the limit value) is detected, this indicates that the medium in the valve has changed from oil to refrigerant. This makes it possible to determine the change of medium in the valve with just one temperature measuring point.

In a particularly easy-to-implement technical design, a starting temperature is determined and a difference between the current temperature and the start temperature is used as words, a parameter. In other start temperature a is determined when the valve is opened. This can be fixed or determined dynamically at the time of opening. The current temperature is then measured continuously as the medium flows through the valve and the difference to the start temperature is calculated. If the difference exceeds a certain value, the valve is closed again. As the temperature decreases with increasing expansion of refrigerant instead of oil, the difference will be negative and "exceeding" here means a specified absolute amount of the negative exceeding difference.

In a further advantageous embodiment, a compressor of the cooling circuit is supplied with oil from the oil collecting container by means of a regulation of the oil level in the compressor. By combining the control described above with a separate oil collecting container, it is possible both to control the emptying of the oil separator in a targeted and demand-oriented manner and to adjust the oil level of the compressor independently of this in an optimized manner.

Regulation of the oil level is understood to mean control that is based on the oil level in the compressor as a control variable and controls a valve in an area between the oil collecting container and the oil inlet of the compressor. If the oil level is too low, the valve is opened; if it is too high, it is closed. Targeted control of the flow rate is also possible, so that the oil lost from the compressor via the refrigerant outlet is continuously replaced.

A considerable additional advantage arises if a number of compressors in the cooling circuit are advantageously supplied with oil from the same oil collecting container by means of separate regulation of the oil level in the respective compressor. By separating the oil level control in the compressor from the oil level control in the oil separator, it is possible to use a central oil collecting container to which the oil separator or all oil separators of the cooling circuit supply oil by means of the valve control described above. At the same time, all compressors, whether they are arranged in the same cooling circuit or in separate sub-circuits, can be optimally supplied with oil from the central oil collecting container by providing a corresponding oil level control in each of the compressors, as described above.

In an additional or alternative advantageous embodiment, furthermore a second temperature is measured in an area upstream of the valve and the difference between the first and second temperatures is used as a parameter. The absolute temperature difference upstream and downstream of the valve is therefore used as a parameter. In this case, a change in the medium in the valve is detected by an increase in this temperature difference and a corresponding limit value is specified for this.

In principle, combinations of the aforementioned parameters can also be used, i.e. determination of both the absolute temperature difference and the speed of the temperature change. This may enable even more precise detection of the change in medium in the valve.

Advantageously, the second temperature is measured in a line between the oil separator and the valve. A suitable additional temperature measuring device can be arranged here, which records the temperature of the flowing medium before the pressure is released in the valve.

In a further advantageous embodiment, a third temperature is further measured in an inlet area of the oil separator, and the third temperature is used to determine the characteristic value and/or the limit value. Knowing the temperature at the inlet of the oil separator as a reference temperature enables even more precise control of the fill level if it is included in the evaluation.

In the methods described, the valve is advantageously opened cyclically. This means that the valve is opened at a predetermined regularity, e.g. once per predetermined period or at a certain opening frequency every X seconds/minutes. It can also take place after a certain time has elapsed after the valve has been closed in accordance with the methods described.

The cycle length, i.e. the average interval between the opening processes, is advantageously determined as a function of the capacity of a compressor. If the capacity of the compressor in a cooling circuit increases because a higher cooling capacity is required, oil is also pumped into the oil separator at a higher rate. Adapting the opening frequency or frequency to the capacity of the compressor, in the sense that a higher capacity also means a higher opening frequency or frequency of the valve, therefore further improves the efficiency of the process.

Finally, a minimum and/or maximum time for opening the valve is advantageously specified in the described control system. This increases the stability of the control system.

A system, comprising an oil separator and an oil collecting container connected downstream on the outlet side via a valve, advantageously comprises a number of temperature measuring devices and a control device adapted to carry out the process described above.

A cooling circuit comprising a compressor and a heat exchanger, with a refrigerant line connecting the compressor to the heat exchanger on the outlet side, advantageously comprises such a system.

The advantages achieved with the invention consist in particular in the fact that an energy-efficient and technically simple needs-based emptying of the oil separator into the oil collecting container of a cooling circuit is achieved by determining the fill level of the oil separator based on temperature changes. Controlling the fill level in the oil separator via the temperature of the outflowing medium does not require adapters or sight glasses and is not susceptible to contamination like previous systems with floats. It enables particularly simple adaptation to different load conditions in the cooling circuit and is technically very easy to implement and therefore cheaper. By using this type of system in combination with an oil collecting container, it is possible to combine optimized draining of the oil separator with the demand-based oil supply of several compressors from a common oil collecting container.

Figure 2:
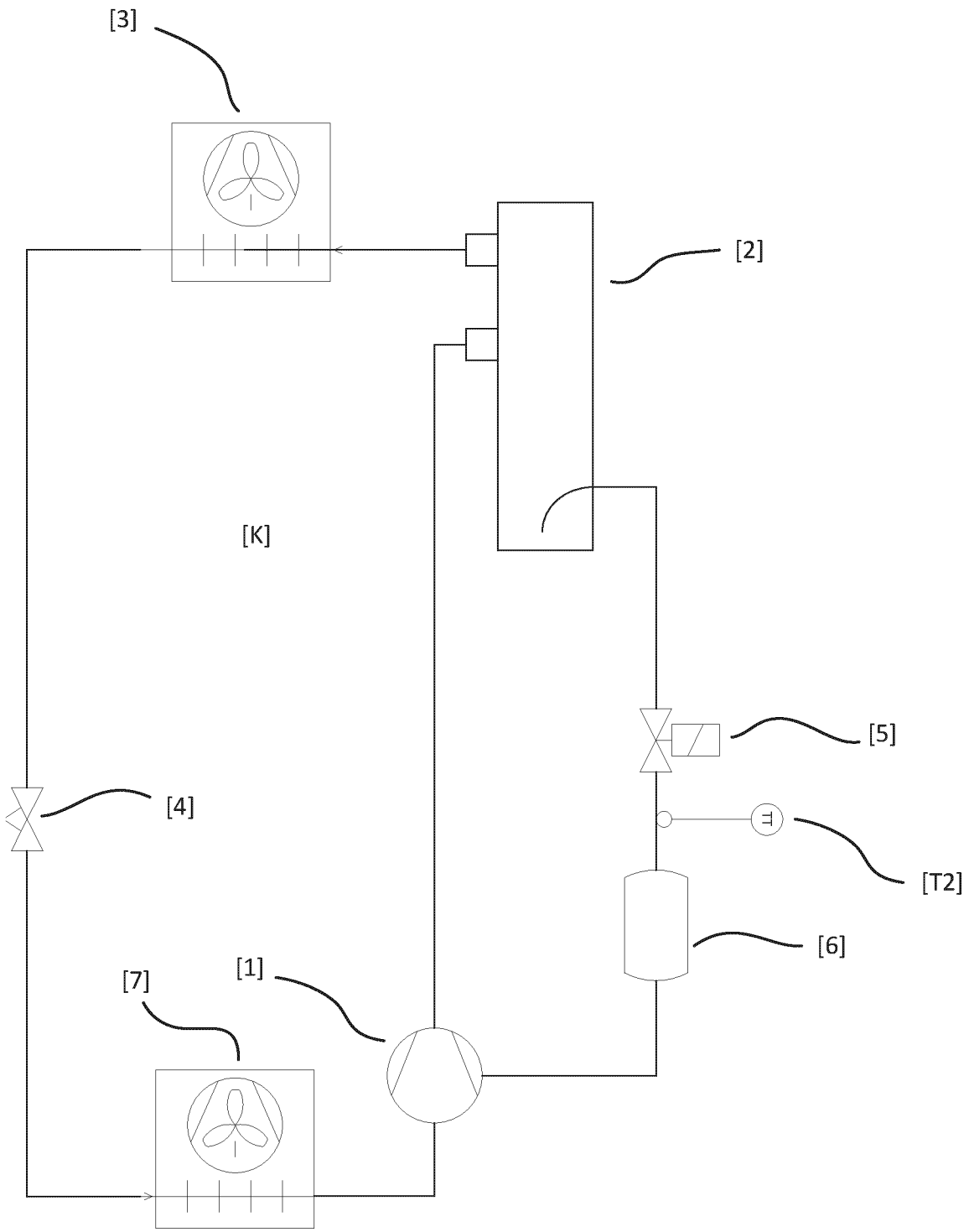
Figure 3:
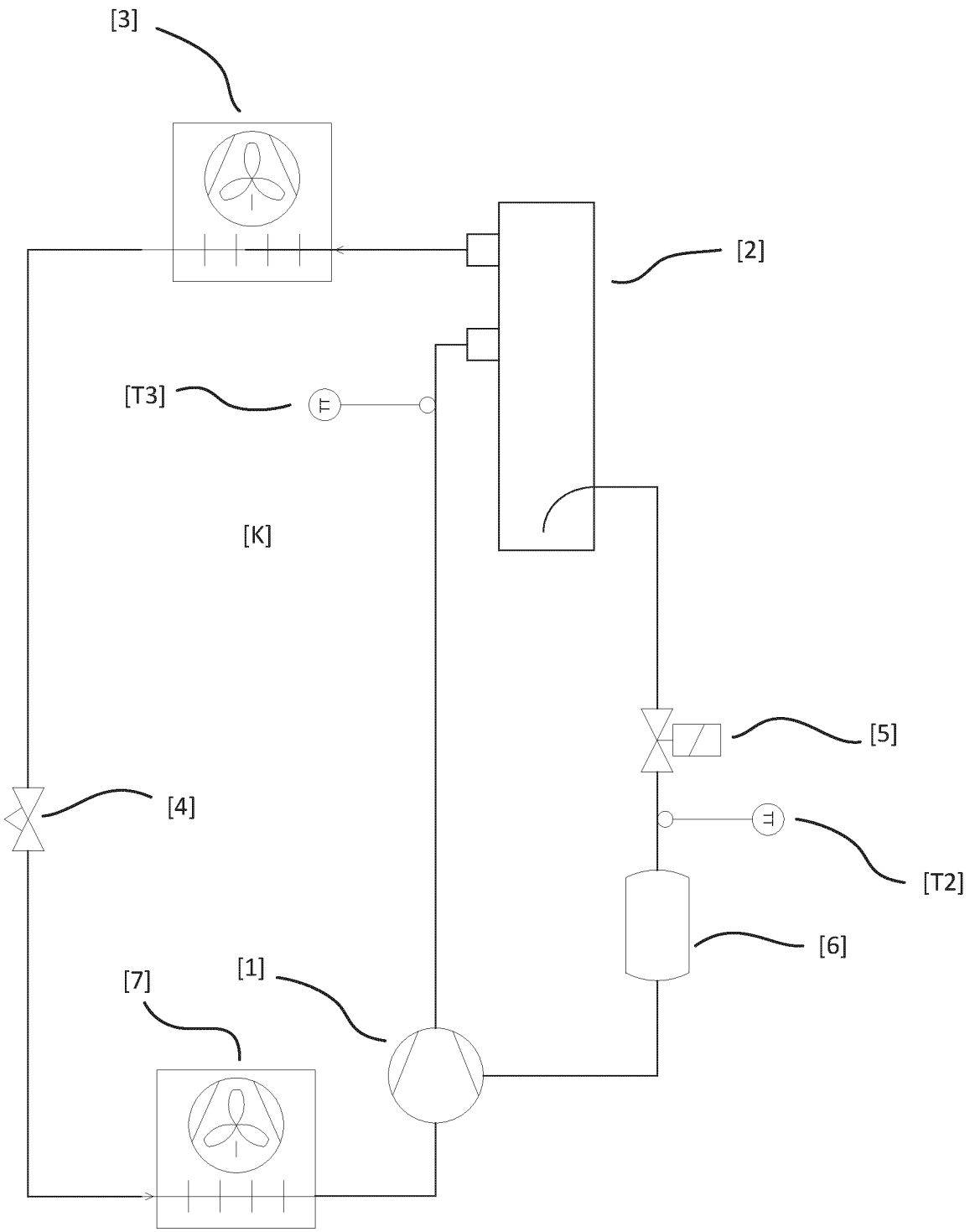
Figure 4:
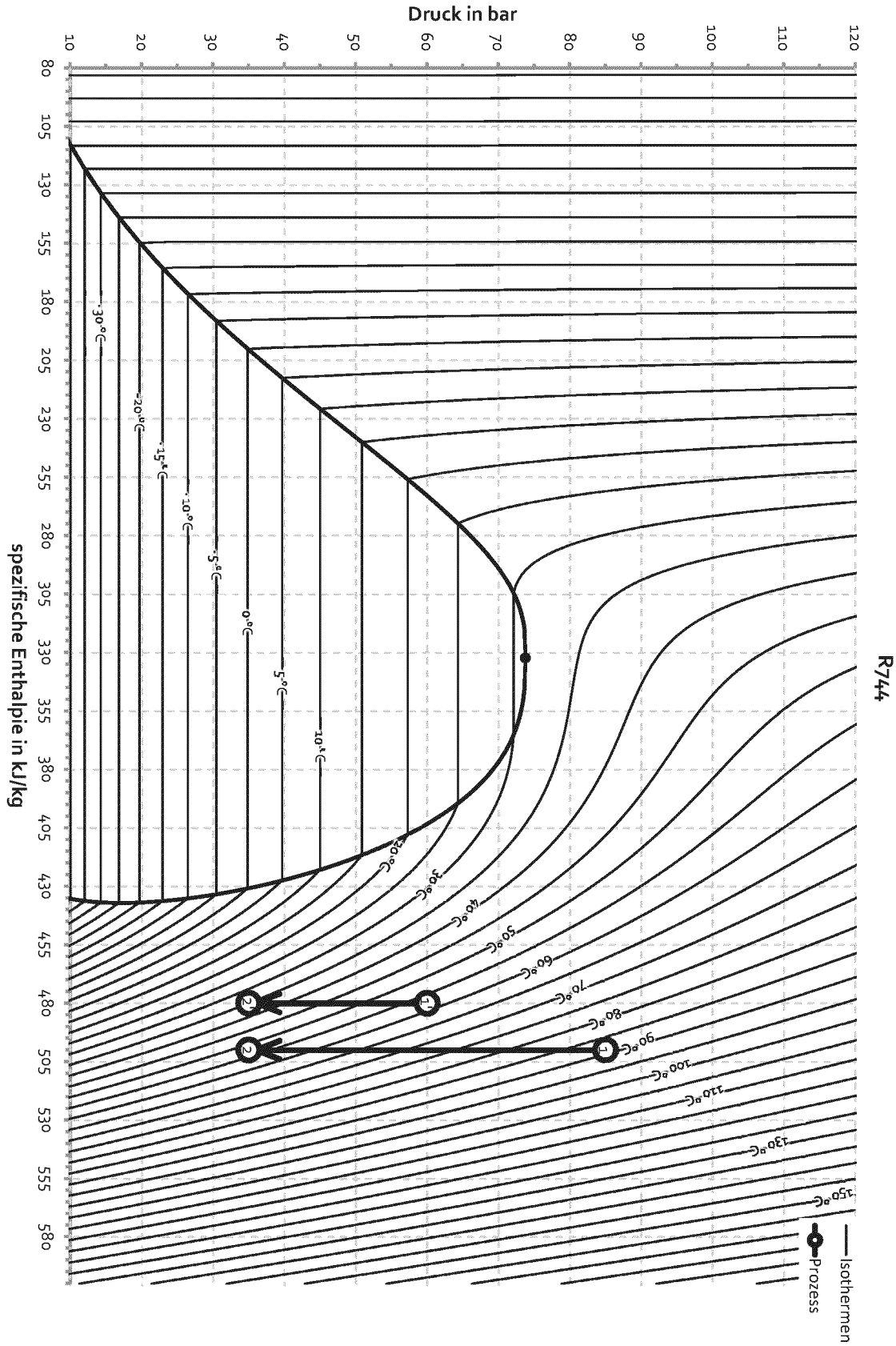

Examples of embodiments of the invention are explained in more detail with reference to drawings. They show:

FIG. 1 a cooling circuit with oil separator and a temperature measuring device upstream and downstream of the valve to the oil collecting container, FIG. 2 the cooling circuit as in FIG. 1 with only one temperature measuring device downstream of the valve, and FIG. 3 the cooling circuit as in FIG. 1, each with a temperature measuring device downstream of the valve and at the inlet to the oil separator, and FIG. 4 a pressure-enthalpy diagram with two examples of isenthalpic expansion in the valve if the oil separator is empty and gas is expanded.

Identical parts are marked with the same reference signs in all figures.

FIG. 1 schematically shows a cooling circuit K. The cooling circuit K is described below starting from a compressor 1. The refrigerant compressed in compressor 1—carbon dioxide in the embodiment example—is first fed into an oil separator 2. In the example, the oil separator 2 is designed as an impact separator and separates oil that has been mixed with the refrigerant in compressor 1 during operation. On the refrigerant side, a heat exchanger 3, designed as a gas cooler in the example, is connected to the oil separator 2, in which the compressed refrigerant is cooled and liquefied. From there, it flows via a throttle element 4 into a heat exchanger 7 designed as an evaporator, where the refrigerant is expanded and absorbs heat so that the desired cooling effect is achieved. From the latter heat exchanger 7, the now gaseous refrigerant flows back into the compressor 1, where it is compressed and the cycle begins again.

So far, only the arrangement of the oil separator 2 with regard to the refrigerant channel in the refrigerant circuit K has been described. With regard to the oil flow, the oil 2 is arranged as follows: An outlet for the separator separated oil is arranged at the bottom of the oil separator 2. This outlet is connected to an oil collecting container 6 via a controllable valve 5, which is designed as a solenoid valve in the embodiment example. The oil is fed back to the compressor 1 from the oil collecting container 6, whereby this is done by regulating the oil level of the compressor 1.

The design of the cooling circuit K described here is the same for all embodiments of FIGS. 1 to 3. The only differences are in the arrangement of the temperature sensors T1, T2, T3. However, this does not mean that the method described below for controlling the fill level of the oil separator 2 is only applicable to such simple cooling circuits K—these are for explanatory purposes only. The method can be applied to any cooling circuits K that have an oil separator 2.

To ensure that the process of draining the separated oil from the oil separator 2 does not cause any unnecessary pressure loss in the cooling circuit K, valve 5 should only be opened as required. The aim here is to ensure that only separated oil flows through valve 5 and not gas, which would be the case if the valve were open and oil separator 2 were empty. For this purpose, the fill level of the oil separator 2 is regulated by opening and closing valve 5 as required as follows:

Valve 5 is opened in a time-controlled manner regardless of the current fill level of oil separator 2. The valve 5 is intended to be opened regularly and cyclically after a predetermined period of time after the last closing. In embodiment examples, this time period can be dynamically dependent on the capacity of the compressor 1, i.e. the cycle length between two opening triggering processes is shortened when the capacity of the compressor 1 is higher. However, it may also be fixed.

The immediate closing of valve 5 after the oil separated in the oil separator 2 has been completely removed is essential for the control methods presented here for the fill level of the oil separator 2. In all embodiment examples, the medium flowing through the open valve 5 is detected for this purpose—as long as oil is still flowing, the valve 5 remains open; as soon as refrigerant flows, the valve 5 is closed immediately.

The fact that the refrigerant in the oil separator 2 is gaseous while the oil is liquid is used to detect the flowing medium in valve 5. An isenthalpic expansion of the medium takes place in valve 5, so that the temperature change across valve 5 can be used to determine whether the flowing medium is liquid or gaseous: If the oil separator 2 is empty and gas is expanded, the temperature drops. When oil is fed through valve 5, it has approximately the same temperature downstream of valve 5 as upstream of valve 5. This can be detected with suitable temperature measuring devices T1, T2, T3. In all embodiments, the temperature measuring devices T1, T2, T3 are connected to a control device, not shown, which controls the opening and closing of the valve 5 using the data from the temperature measuring devices T1, T2, T3 with corresponding hardware and software.

In the embodiment example of FIG. 1, two temperature measuring devices T1, T2 are provided for this purpose. These are arranged in the supply lines upstream and downstream of valve 5, i.e. between oil separator 2 and valve 5 (T1) and between valve 5 and oil collecting container 6 (T2). The temperature measuring devices T1, T2 measure the temperature of the medium in the supply lines.

As explained above, a gaseous flowing medium in valve 5 results in a temperature drop across valve 5. Therefore, the temperature difference between the measured temperatures at the two temperature measuring devices T1, T2 is used as a parameter in the method of the embodiment example of FIG. 2. A temperature difference is specified as a limit value. As soon as this limit value is exceeded, i.e. the temperatures deviate by more than the limit value, the valve 5 is closed again.

In contrast to FIG. 1, only one temperature measuring device T2 is provided in the embodiment example of FIG. 2. This is arranged between valve 5 and oil collecting container 6 and measures the temperature of the flowing medium immediately after valve 5. The control device therefore only has a single temperature value; no difference can be formed.

Instead, in the embodiment example of FIG. 2, it is intended to detect the sharp drop in temperature at the temperature measuring device T2 when the medium in valve 5 changes from oil to refrigerant after the oil separator 2 has been emptied. For this purpose, the derivative of the measured temperature value is continuously formed in the control device after valve 5 is opened and used as a parameter. A limit value is specified for the negative derivative. As soon as this limit value is exceeded, i.e. the temperature is reduced even faster than the limit value specifies, valve 5 is closed again.

A further alternative embodiment example, which requires structurally identical devices as in FIG. 2, is explained below. Only the type of control differs from the previous example explained with reference to FIG. 2. In this embodiment example, a starting temperature is first determined when the valve 5 is opened. For this purpose, a fixed value, e.g. −20° C., is initially specified. The current temperature is then recorded at the temperature measuring device T2. If the temperature is higher, this recorded value becomes the start temperature, otherwise the start temperature remains at the specified example value of −20° C. The difference between the start temperature and the current temperature at the temperature measuring device T2 is then continuously determined. If the difference exceeds a predetermined limit value, for example 4° C. (i.e. the current temperature is lower than the start temperature minus the predetermined limit value), the valve is closed again.

Optionally, a higher-level time control is also provided in the described embodiment example, in which a minimum and maximum opening time are specified, which are maintained regardless of the temperature behavior. For example, the control could be set so that the valve 5 remains open for a minimum of, for example, 10 seconds and a maximum of, for example, 60 seconds. It is only closed prematurely again within these limits due to the temperature control described.

FIG. 3 shows a further embodiment example with two temperature measuring devices T2, T T3. The temperature measuring device T2 is arranged at the same location as the temperature measuring device T2 in FIG. 2. The temperature measuring device T3, on the other hand, is arranged at the inlet to the oil separator 2 and ultimately measures the temperature of the medium flowing out of the compressor 1 (compressed refrigerant with admixture of oil).

In the embodiment example of FIG. 3, the control is essentially applied as described for FIG. 2, i.e. via the derivation of the temperature value at the temperature measuring device T2 as a characteristic value. Here, however, the temperature value at the temperature measuring device T3 is included as a reference value, i.e. the characteristic value and/or the limit value are dynamically modified on the basis of this reference value if necessary.

In general, mixed forms are also possible, i.e. combined parameters and limit values from the variables and values described in FIGS. 1 to 3. It is essential to detect the change of the flowing medium through the valve from liquid oil to gaseous refrigerant as quickly as possible. This is achieved by cooling with isenthalpic expansion in valve 5, as shown in FIG. 4. FIG. 4 shows a pressure-enthalpy diagram of a typical refrigerant. Two examples of isenthalpic expansion in valve 5 are shown as examples, from point 1' to 2' and from point 1 to 2. In both cases, clear temperature drops of 20 and 30 K respectively can be seen, which are detected using the methods described above.

The system described offers additional advantages in cooling circuits that are not shown in the illustration and have several compressors 1. This applies to cooling circuits with separate sub-circuits as well as simple cooling circuits that use several parallel compressors, e.g. due to the required capacity. These can have several or a single oil separator 2. In any case, the control system described makes it possible to use only a single oil collecting container 6, as the control of the draining of the oil separator 2 and the refilling of the compressors 1 with oil are independent of each other.

LIST OF REFERENCE SIGNS

1 Compressor
2 Oil separator
3 Heat exchanger
4 Throttling device
5 Valve
6 Oil collecting container
7 Heat exchanger
K Cooling circuit
T1 Temperature measuring device
T2 Temperature measuring device
T3 Temperature measuring device

The invention claimed is:

1. A method for controlling a fill level of an oil separator (2) for a cooling circuit (K), comprising:

connecting a controllable valve (5) downstream of an outlet of the oil separator (2) through which oil is fed into an oil collecting container (6), wherein, after the controllable valve (5) is opened, measuring a first temperature by a temperature measuring device arranged in a line between the controllable valve (5) and the oil collecting container (6), specifying a limit value for at least one parameter that is characteristic of a change in the first temperature, and closing the controllable valve (5) as soon as the at least one parameter exceeds the specified limit value characterized in that the oil separator (2) is connected downstream of a compressor (1) on an outlet side of the outlet, and that, for an opening of the controllable valve (5), a starting temperature is determined dynamically based on the first temperature measured by the temperature measuring device when the controllable valve is opened, and a difference between a subsequently measured value of the first temperature and the starting temperature is used as the at least one parameter.

2. The method according to claim 1, wherein the compressor (1) of the cooling circuit (K) is supplied with the oil from the oil collecting container (6) by using an oil level in the compressor (1) as a control variable and controlling a further valve between the oil collecting container (6) and an oil inlet of the compressor (1) based on the oil level.

3. The method according to claim 1, wherein furthermore a second temperature is measured in a region upstream of the controllable valve (5) and the difference between the first and the second temperature is used as a characteristic parameter.

4. The method according to claim 3, wherein the second temperature is measured in a line between the oil separator (2) and the controllable valve (5).

5. The method according to claim 4, wherein a third temperature is further measured in an inlet region of the oil separator (2), and the third temperature is used in determining the characteristic parameter and/or the limit value.

6. The method according to claim 1, wherein the opening of the controllable valve (5) is carried out cyclically.

7. The method according to claim 6, wherein a cycle length is determined as a function of a capacity of the compressor (1).

8. The method according to claim 1, in which a minimum and/or a maximum time for opening the controllable valve is predetermined.

9. A system, comprising an oil separator (2) and an oil collecting container (6) connected downstream on an outlet side via a controllable valve (5), a number of temperature measuring devices (T1, T2, T3) and a control device, adapted for carrying out a method for controlling a fill level of the oil separator (2), the system comprising:

a controllable valve (5) connected downstream of an outlet of the oil separator (2) through which oil is fed into the oil collecting container (6), wherein, after the controllable valve (5) is opened, a first temperature is measured by a temperature measuring device arranged in a line between the controllable valve (5) and the oil collecting container (6), a limit value is specified for at least one parameter that is characteristic of a change in the first temperature, and the controllable valve (5) is closed as soon as the at least one parameter exceeds the limit value, characterized in that the oil separator (2) is connected downstream of a compressor (1) on an outlet side of the outlet, and that, for an opening of the controllable valve (5), a starting temperature is determined dynamically based on the first temperature measured by the temperature measuring device when the controllable valve is opened, and a difference between a subsequently measured value of the first temperature and the starting temperature is used as the at least one parameter.

10. A cooling circuit (K) comprising a heat exchanger (3), wherein a refrigerant line connects the compressor (1) on the outlet side to the heat exchanger (3), further comprising a system according to claim 9.

* * * * *